United States Patent [19]

Kersavage

[11] Patent Number: 4,651,479

[45] Date of Patent: Mar. 24, 1987

[54] PROTECTIVE STRUCTURAL MODULE AND METHOD FOR CONSTRUCTION

[76] Inventor: Joseph A. Kersavage, 5709 Lyons View, West Cliff Condo 1217, Knoxville, Tenn. 37919

[21] Appl. No.: 739,130

[22] Filed: May 30, 1985

[51] Int. Cl.[4] ..... E04B 1/32

[52] U.S. Cl. ..... 52/80; 52/82

[58] Field of Search ..... 52/80, 81, 82

[56] References Cited

U.S. PATENT DOCUMENTS

| | | | |
|---|---|---|---|
| 2,365,145 | 12/1944 | Neff | 52/80 |
| 2,891,491 | 6/1959 | Michter | 52/81 |
| 3,090,162 | 5/1963 | Baroni | 52/80 |
| 3,092,932 | 6/1963 | Wilson | 52/80 |
| 3,296,755 | 1/1967 | Chisholm | 52/169.6 |
| 3,727,356 | 4/1973 | Appenzeller | 52/81 |
| 3,927,496 | 12/1975 | Kersavage | 52/80 |
| 3,931,697 | 1/1976 | Pearce | 52/80 |
| 4,144,680 | 3/1979 | Kelly | 52/80 |
| 4,291,679 | 9/1981 | Kersavage | 126/438 |
| 4,425,740 | 1/1984 | Colder | 52/81 |

FOREIGN PATENT DOCUMENTS

| | | | |
|---|---|---|---|
| 450640 | 7/1949 | Italy | 52/80 |

*Primary Examiner*—Henry E. Raduazo
*Attorney, Agent, or Firm*—Luedeka & Neely

[57] ABSTRACT

The specification discloses a structural module for forming and protecting an enclosed space over a floor and a method for constructing a structural module. The structural module includes at least three apex hypars joined together at an apex to form the enclosed space with at least three triangular openings formed between the apex hypars and the floor. At least one base hypar is formed between one of the triangular openings in the floor. The apex hypers include a pair of linear wall edges extending upwardly and outwardly from a support point on the floor and a pair of linear roof edges attached at the upper edges of the linear wall edges and being joined at the apex. The base hypar includes a pair of base edges extending along the floor from two of the adjacent support points for the wall edges of the apex hypar to a base point. Two upright edges extend upwardly from the support points and each is coextensive with the linear wall edge of an adjacent apex hypar. In the form of the module where the triangular openings are vertical, the modules are easily joined at the vertical triangular openings to provide one enclosed space. Employing the disclosed method for construction, the module is formed from a laminar composite having layers providing resistance to compression and having layers providing tensile strength and is suitable for use as a blast-resistant underground bomb shelter or other such protective structure.

10 Claims, 12 Drawing Figures

PROTECTIVE STRUCTURAL MODULE AND METHOD FOR CONSTRUCTION

The present invention relates to a structural module for enclosing and protecting a space over a floor and more particularly relates to a blast-resistant structural module and a method for its construction.

Many types of structures are known for enclosing and protecting a space over a floor. Where structures are to be subjected to great external forces such as storm shelters, underground houses, and earthquake-resistant structures, the conventional approach for the design of protective structures has been to employ walls and roof having a great thickness and thus great overall strength. For example, conventional structures for use as underground bomb shelters include a barrel vault or rectangular box constructed of reinforced concrete. Typically, for such structures to have sufficient strength to resist breach and to prevent spalling inside the structural module, it is necessary for the wall thickness to exceed three feet or more. Consequently, it is necessary for such structures to be constructed essentially entirely on site and extensive "formwork" is required for the poured concrete employed in the construction. In addition, it is generally necessary for each conventional protective structure of a different size to be custom designed and constructed. Conventional structures are thus expensive, labor intensive and time consuming to construct.

In accordance with one aspect of the present invention a structure having double opposed curvatures is provided which is highly resistant to great external forces such as shock from a bomb blast or earthquake or the loading caused by burying the strucutre. Various structures are known which employ surfaces having double opposed curvature such as those disclosed in U.S. Pat. Nos. 3,927,496 and 4,291,679. Generally, these structures include a frame with coated screening or other flexible membrane defining double opposed surfaces. While the structures disclosed have a good strength to weight ratio, these structures are generally unsuitable for use in resisting large compressive forces and shock such as is necessary for an underground bomb shelter or other such structure.

Therefore, a need has arisen for a structural module for enclosing and protecting a space over a floor which can withstand large external forces. The module should be easily joined with like modules to form one enclosed space. Moreover, a need has arisen for a blast-resistant structural module which is easy to construct and which minimizes the amounts of material employed in construction.

In accordance with one form of the present invention, a structural module is provided which includes at least three apex hypars joined together at an apex to form the enclosed space with at least three triangular openings formed between the apex hypar and the floor. The structural module further includes at least one base hypar formed between one of the triangular openings in the floor. The apex hypars include a pair of linear wall edges extending upwardly and outwardly from a support point on the floor at a pair of linear roof edges attached at the upper edges of the linear wall edges and being joined at the apex. The linear wall edges and linear roof edges define the perimeter of a surface having a double opposed curvature which, when viewed from outside the module, has a convex cross-section in a vertical plane passing through the apex and the support point. The base hypar includes a pair of base edges extending along the floor from two adjacent support points for the wall edges of the apex hypar to a base point. Two upright edges extend upwardly from the support points and each is coextensive with the linear wall edges of an apex hypar. The base edges and upright edges define the perimeter of a surface having a double opposed curvature which, when viewed from outside the module, has a concave cross section in a vertical plane passing through the apex and the base point.

In accordance with a more particular form of the present invention a wall edge of one apex hypar and an adjacent wall edge of a second apex hypar are disposed in a substantially vertical plane to define a substantially vertical opening whereby two like structural modules may be joined together to form one enclosed space by joining together the vertical triangular openings of the two modules.

In accordance with a more particular form of the present invention, each of the apex hypars include a pair of steel wall rods forming the wall edges, a pair of steel roof rods forming the roof edges, a plurality of steel cross rods extending between the wall rods and roof rods, a screen stretched between the roof rods and the wall rods being disposed adjacent the cross rods and a layer of concrete encasing the wall rods, the roof rods, and the cross bars.

In accordance with a more particular aspect of the present invention, a plurality of glass fiber screen cross bands are tensioned between the wall rods and the roof rods in a crossing pattern to form a substantially continuous screen surface between the wall and roof rods below the steel cross rods. In addition, a plastic cement is coated onto and encases a plastic screen. A polyester screen is disposed below and attached to the plastic screen and a acrylic coating is formed on and encases the glass fiber screen. At least one layer of concrete is formed on the glass fiber screen and encases the cross rods.

In accordance with another more particular aspect of the invention, the structural module further includes a glass mat disposed on and above the layer of concrete and a layer of asphalt is formed on and above the glass mat.

In accordance with the method of the present invention, apex hypar shell elements and base hypar shell elements are fabricated and are assembled to form a shell for the module. Apex hypar elements are fabricated from pairs of wall rods and roof rods and base hypar elements are fabricated from pairs of base rods and upright rods which define double opposed curvatures. Cross rods are secured in a generally perpendicular relationship to opposing rods of the hypar element. Fabrication of the elements further includes stretching screen bands between both sets of opposing edges and coating the bands with an adhesive to encase the screen. After assembly of the apex and base shell elements at least one layer of concrete is coated on the screen bands of the resulting shell to encase the rods and form a first layer of reinforced concrete.

In accordance with a more particular form of the present invention, the method further includes providing a layer of reinforcing bar above the first layer of concrete and coating concrete onto the layer of reinforcing bar to form a second layer of reinforced concrete and then coating concrete onto the second reinforced layer of concrete to provide an unreinforced layer of concrete.

In accordance with another more particular form of the present invention, a layer of fiberglass mat is placed on the structural module and is coated with asphalt.

The present invention may best be understood by reference to the following detailed description when considered in conjunction with the accompanying drawings in which.

Figure 1:
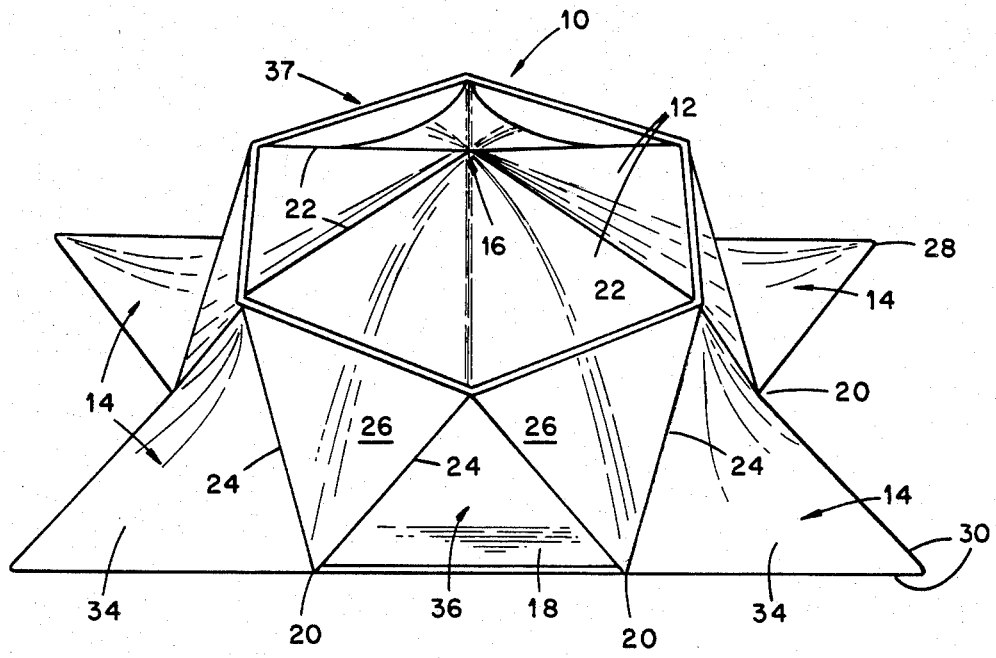
FIG. 1 is a perspective view of one form of the structural module of the present invention.

Referring now to the drawings in which like reference characters designate like or corresponding parts throughout the several views, there is shown in FIG. 1 a structural module 10. The structural module 10 is formed from two structural shapes, apex hypars 12 and base hypars 14. The term hypar as used in this application is intended to refer to a structural shape with four linear edges and a surface with double-opposed curvature, i.e. the surface is curved about two nonparallel axes. To illustrate, a hyperbolic paraboloid surface extending between four linear edges is an example of a hypar. By the use of the term "hypar", there is no intent to limit the present invention to structural shapes which have hyperbolic paraboloid surfaces and any shape having a surface with double-opposed curvature with a four linear edges is meant to be encompassed by the term.

Referring still to FIG. 1, it is shown that the structural module 10 includes six apex hypars 12 which are joined together at an apex 16 above a floor 18. Each of the apex hypars 12 include two roof edges 22 which are shared by adjacent apex hypars 12. The upper ends of each of the roof edges 22 are joined together at the apex 16 of the structural module 10. Each of the six apex hypars 12 has a pair of wall edges 24 which extend from the lower ends of the roof edges 22 to support points 20 on the floor 18. Extending between the pair of roof edges 22 and the pair of wall edges 24 for each of the apex hypars 12 is an apex hypar surface 26. When viewed from outside the module 10, the apex hypar surfaces 26 have a convex curvature in a vertical plane extending between the apex 16 and the support point 20 and has a concave curvature in a second plane nonparallel to the first plane. While in the preferred embodiment depicted, six apex hypars 12 are employed, it will be understood that modules 10 may have a fewer or greater number of apex hypars 12 to satisfy design requirements provided that at least three apex hypars are employed. A structural module having either apex hypars is most suitable for some applications.

As illustrated in FIG. 1, the structural module 10 includes five base hypars 14 (four of which are shown in FIG. 1). Each of the five base hypars includes a base point 28 on the floor 18 which defines a triangle with respect to the two adjacent support points 20 for the apex hypars 12. Each of the five base-hypars includes a pair of base edges 30 which extend from the base point 28 to the two adjacent support points 20 of the two adjacent apex hypars 12. The base hypars 14 further include two upright edges which are coextensive with the wall edges 24 of the apex hypars 12 and thus are also indicated by the numeral 24. The upright edges 24 extend from two support points 20 and are joined together at their upper ends and also join to the end of a roof edge 22. Extending between the pair of base edges 30 and the two upright edges 24 for each of the base hypars 14 is a base hypar surface 34. When viewed from outside the module 10, the base hypar surfaces 34 have a double-opposed curvature with a concave curvature in a vertical plane which passes through the apex 16 and the base point 28 and a convex curvature in a second plane nonparallel to the first plane.

Referring still to FIG. 1, it is shown that a triangular opening 36 is provided between the apex hypars 12 and the floor 18. The triangular opening 36 provides access into an enclosed space within the structural module 10. In the embodiment of the structural module 10 depicted in FIG. 1, the wall edges (and upright edges) 24 of adjacent apex hypars 12 defining the triangular opening are both disposed in a substantially vertical plane to define a substantially vertical triangular opening 36 in the structural module 10.

While in the preferred embodiment five base hypars 14 and one triangular opening 36 are employed, it will be understood that fewer base hypars 14 can be employed to result in additional triangular openings 36. Further, it will be understood that in modules 10 with a fewer or greater number of apex hypars 12, that the total number of base hypars 14 and openings 36 equals the number of apex hypars 12.

In the preferred form of the invention shown in FIG. 1, the module 10 further includes a tensile ring 37 comprised of six linear segments which extend between adjacent interconnections between the lower ends of the roof edges 22 and the upper ends of the wall edges (upright edges) 24.

Figure 2:
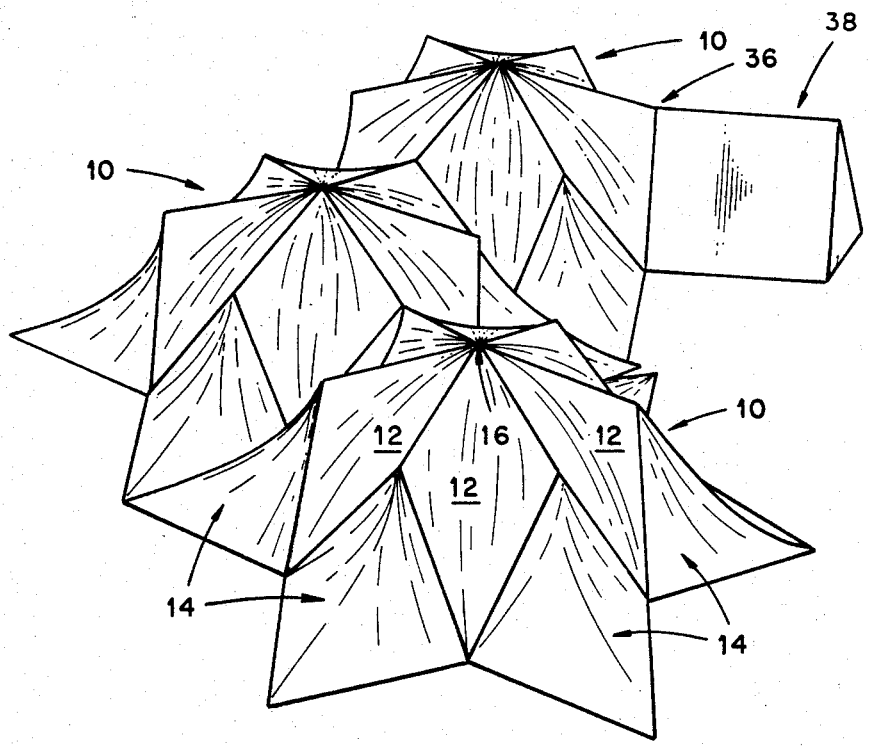
FIG. 2 is a perspective view of one arrangement of interconnected structural modules according to one form of the present invention.

Referring now to FIG. 2, there are shown three interconnected structural modules 10. In each of the structural modules 10, the triangular openings 36 are substantially vertical so that the triangular openings 36 of the structural modules can be joined to form one enclosed space. It should be noted that interconnected structural modules 10 which are joined to two adjacent structural modules 10 require two triangular openings 36 so that adjacent modules can be interconnected. It is also to be understood that while FIG. 2 shows one form of interconnected structural modules 10, there are many varied arrangements whereby structural modules 10 can be interconnected in any of various patterns including linear patterns, Y-shaped patterns, rings, zig-zags and even entirely random patterns. For the form of the structural modules 10 illustrated, it is possible to have up to three modules 10 connected to one module 10.

As shown in FIG. 2, an A-frame structure 38 is shown connected at an opening 36 to extend the structure to provide an opening at a location remote from module 10. Such A-frame structures 38 are easily constructed of materials similar to those employed in constructing the module and are easily joined to module 10 at the opening 36 when dimensioned to mate with the opening 36.

Figure 3:
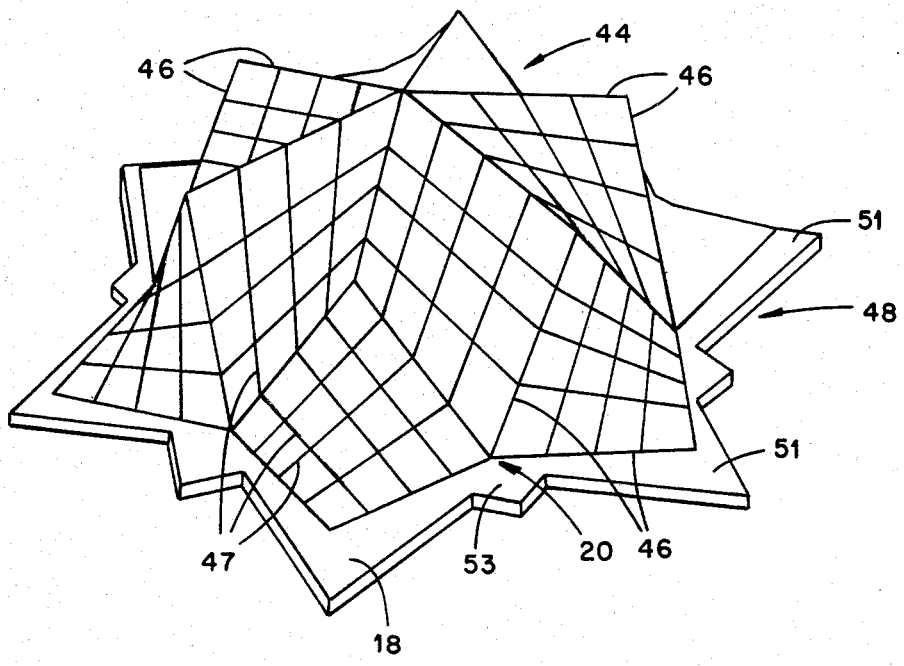
FIG. 3 is a perspective view showing a base and reinforcing framework utilized in one form of the invention.

As illustrated in FIG. 3, the linear edges of apex hypars 12 and base hypars 14 of the structural module 10 are defined by a reinforcing framework 44. The main components of the framework 44 are linear elongated members 46 which are interconnected to define the apex 16, the roof edges 22, the wall edges (upright edges) 24, the base edges 30 and the triangular opening 36. The framework includes a plurality of linear cross members 47 extending between and being attached to opposing elongated members 46 an being generally perpendicular to the elongated members 46. The cross members extend from both sets of opposing elongated members and cross members 47 intersect generally at right angles. The framework 44 provides support for and reinforces the other components of the module 10 as will be described in more detail hereinafter.

The framework 44 is connected to a generally planar base 48 which provides the floor 18 and which is rigid to lend support to the structural module 10 and to prevent distortion of the overall structure. In the preferred embodiment, the base 48 for the structural module 10 depicted is generally star-shaped with six points 51 of the star extending outwardly to conform generally to the triangle defined by the base edges 30 and being for supporting the base hypars 14. Preferably, the base 48 is larger than the framework 44 as shown and is made of a rigid material such as reinforced concrete. In addition, the preferred embodiment includes six secondary star points 53 positioned between adjacent points 51 and being for extending the base 48 adjacent to the support points 20.

Figure 4:
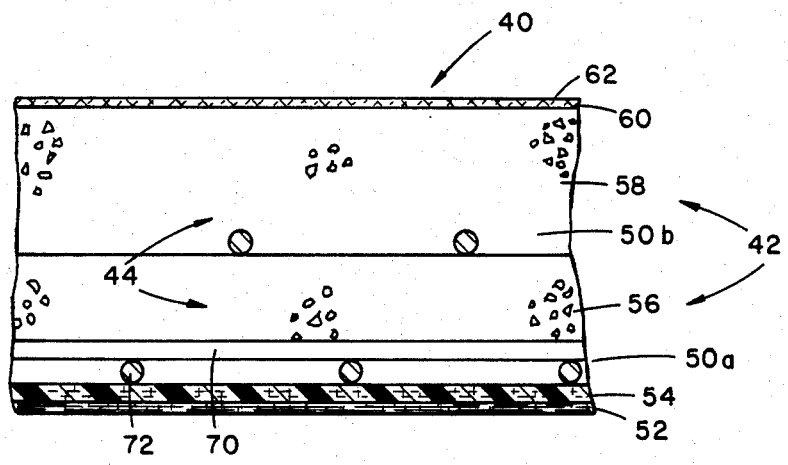
FIG. 4 is a cross-section view of a preferred composite employed in one form of the module of the present invention.

Referring now to FIG. 4 showing a preferred construction for the structural module 10 according to the present invention, there is shown in cross-section a laminar composite 40 which incorporates the framework 44 and spans between the elongated members 46 forming the framework 44 to form a unitary shell having surfaces defining the apex hypar surface 26 and base hypar surface 34 of the hypars 12 and 14 respectively. The laminar composite 40 is constructed of layers 42 which provide both compression resistance and mass to absorb and dissipate shock and layers to providing tensile strength to resist gross distortion and to prevent breach due to such distortion. The composite 40 incorporates the framework 44 and is attached to the base 48 to define a unitary structural module 10 whereby the entire structural module 10 functions as a unit which is resistant to external forces and which is capable of protecting the enclosed space 38.

As illustrated in FIG. 4, the preferred composite 40 incorporates the reinforcing framework 44. The framework is provided by steel rods such as #6 rebar and, preferably, two spaced-apart layers of steel rods, a first layer 50*a* and a second layer 50*b*, respectively, are incorporated into the composite 40 as will be described. Adjacent to the first layer of steel rods 50*a*, is a vinyl-coated fiberglass screen 54 embedded in plastic. Above the fiberglass screen 54 is a first layer of concrete 56 which is reinforced by and incorporates the first layer of steel rods 50*a*. Above the first layer of concrete is the second layer of steel rods 50*b* and a second layer of concrete 58 is reinforced by and incorporates the second layer of steel rods 50*b*. Adjacent to and above the second layer of concrete is a waterproof layer, preferably a fiberglass mat 60 which is coated with and attached to the second layer of concrete with a layer of asphalt 62. For some applications of the module 10, it is preferable to provide an anti-spall coating on the inside of the structure adjacent to the screen layer 54 embedded in plastic. As illustrated, the anti-spall layer is preferably a layer of polyester screen 52 embedded in acrylic plastic.

The laminar composite 40 employed in the preferred form of the module 10 is formed when the module 10 is constructed in situ by prefabricated construction where elements with a complete laminer composite are assembled to form the module 10, or by a combination of prefabricated and in situ construction as is preferred and described in detail hereinafter.

Figure 5:
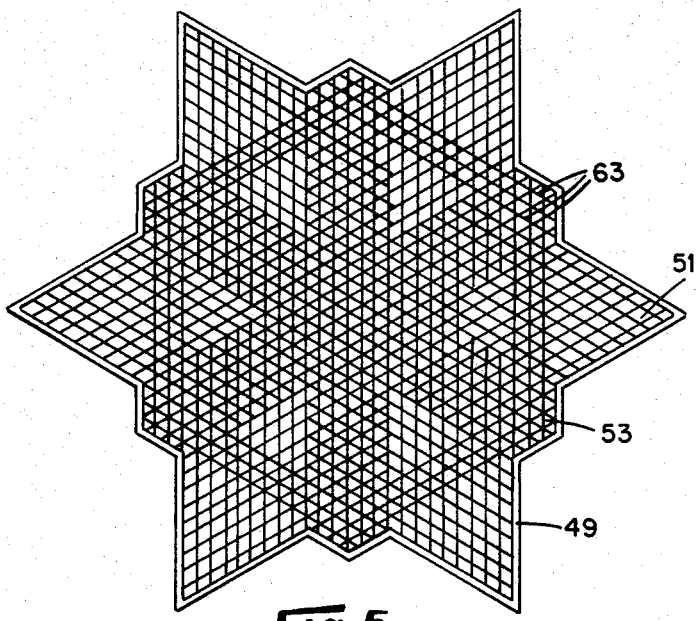
FIGS. 5 through 11 are views of partially-constructed shell elements constructed in accordance with one form of the method of the present invention.

Additional aspects of a preferred module 10 according to the present invention are shown in FIGS. 5–12 illustrating a method for construction of a blast-resistant structural module. The method according to the present invention for constructing a blast-resistant structural module includes forming the base 48 for the module 10 of reinforced concrete. Preferably as shown in FIG. 5, the base 48 is formed in a star-shaped configuration with points 51 and secondary points 53 using an appropriate form 49 and with reinforcing rods 62 extending into the points 51 and secondary points 53 of the base 48. Most preferably, three layers of reinforcing rods 62 are employed and are arranged such that two sets of rods 62 extend into each point 50 parallel to the sides of the point and the three layers of rods 62 intersect to define generally equilateral triangles. Concrete is poured into the form 49 and is smoothed to provide a generally planer upper surface for the base 48. It will be understood that similar forms and orientation of reinforcing rods are employed to construct modules with a greater or fewer number of apex hypars. For example, for a module with eight apex hypars, the base has an eight-pointed star configuration and two layers of rods may be employed for extending into each of the points of the star.

Figure 12:
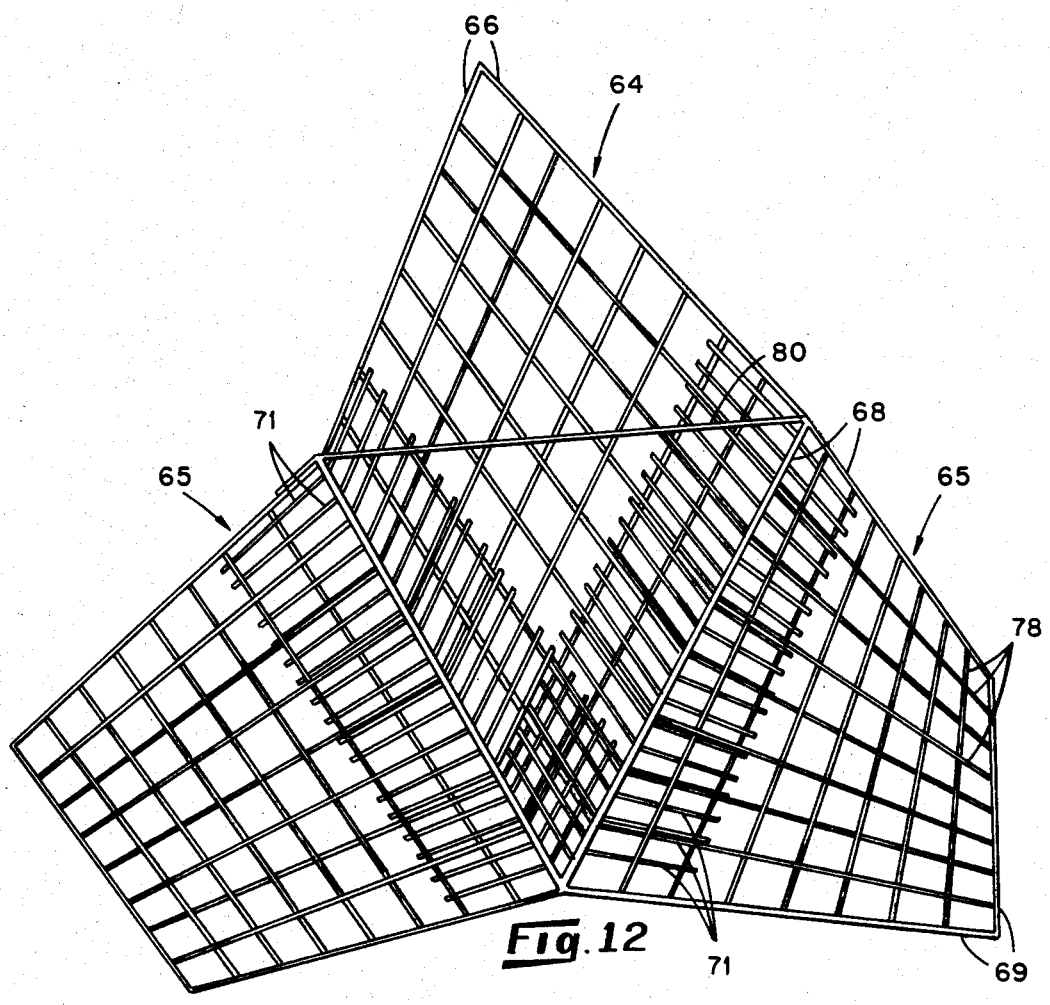
FIG. 12 is a perspective view showing the reinforcing framework provided by two base hypar shell elements and an apex hypar shell element as constructed according to one form of the method of the present invention.

In the method of the present invention, the reinforcing framework 44 for the structural module 10 is partially constructed from apex shell elements 64 and base shell elements 65 (one apex shell element 64 and two base shell elements 65 are shown assembled in FIG. 12) including the plastic embedded fiberglass screen layer 54. Shell elements 64 and 65 preferably are prefabricated and then are interconnected and attached to the base 48 to form the framework 44 for the structural module 10.

Figure 6:
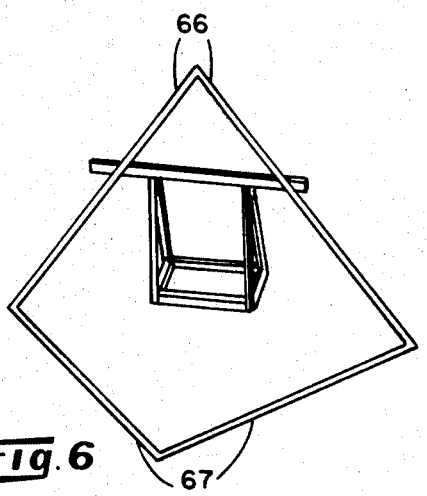

Referring to FIG. 6, an apex shell element 64 is constructed by providing a pair of steel roof rods 66 which are secured together at an appropriate angle for the structural module 10 and a pair of wall rods 67 which are disposed in a second plane which is different from the plane of the roof rods 66. The angle between the pairs of rods and the angle between adjacent rods is determined by the number of apex hypars of the structural module 10 and according to design requirements. For example, in the structural module illustrated in FIG. 1 with six apex hypars 12, the angle between the roof rods 66 at the apex is 60°. In a module with eight apex hypars, the angle is 45°. The angle between the roof rods 66 and the wall rods 67 for an apex hypar is determined by both the slope of a wall edge 24 desired and the slope of roof edge 22 desired and must be such that the surface of the apex hypars has a convex curvature when intersected with a vertical plane passing through the apex 16. In addition, where it is desired for the triangular openings 36 to be vertical, it is necessary to adjust the angle between the roof rods 66 and the wall rods 67 to be such that the wall rods 67 of adjacent apex shell elements 64 define a vertical triangular opening.

For the construction of base hypar elements 65, pairs of attached upright rods 68 and attached base rods 69 (see FIG. 12) are attached to lie in planes such that the surface provided has a concave curvature when intersected with a vertical plane passing through the apex 16. When it is desired for a vertical triangular opening 36 to be formed, the angle between the pairs of bars must be 90°. The upright rods 68 for the shell element must generally conform in length to the wall rods 67 of an apex shell element 64. The base rods 69 should have a length provide a desired slope of the wall of the module 10 to meet design requirements for the structure.

Figure 7:
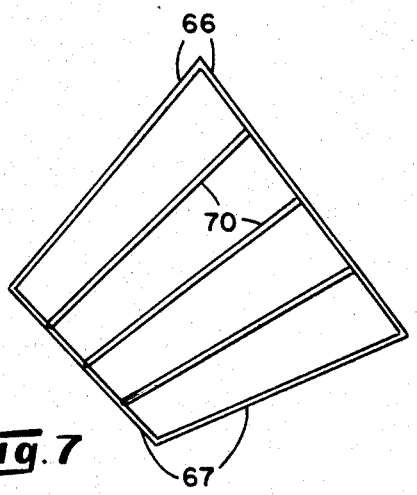
Figure 8:
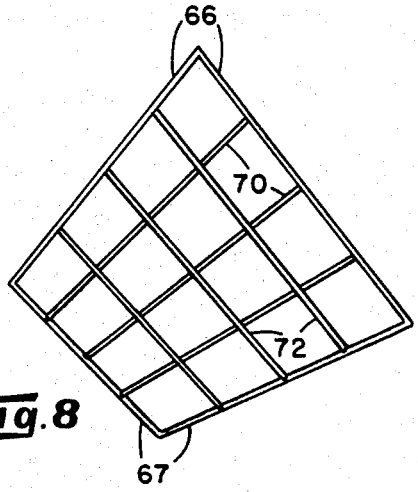

As illustrated in FIG. 6 for an apex hypar element 64, and which is applicable for the fabrication of either an apex or base shell element, pairs of bars are suitably provided by rebar connected by suitable means such as welding. Then, the pairs of bars are connected. Once the pairs of adjacent bars are attached together, first cross-bars 70 such as reinforcing rods are attached in one direction between opposing bars as illustrated in FIG. 7 such as by welding. As illustrated in FIG. 8 second cross-bars 72 are similarly added such as by welding so that intersecting cross bars intersect generally at right angles. For additional strength, the cross bars can be welded at their intersections is desired.

The method further includes the application of screen bands, preferably of vinyl coated fiberglass screening, which are then embedded in a plastic cement.

Figure 9:
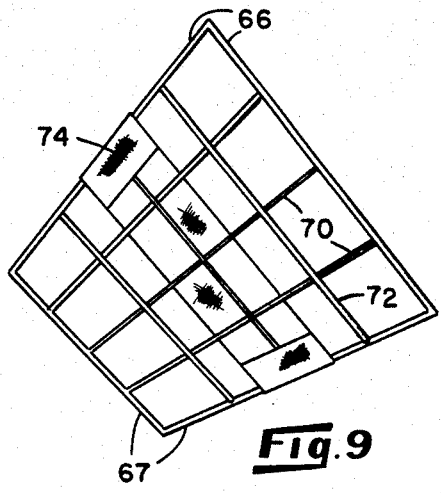
Figure 10:
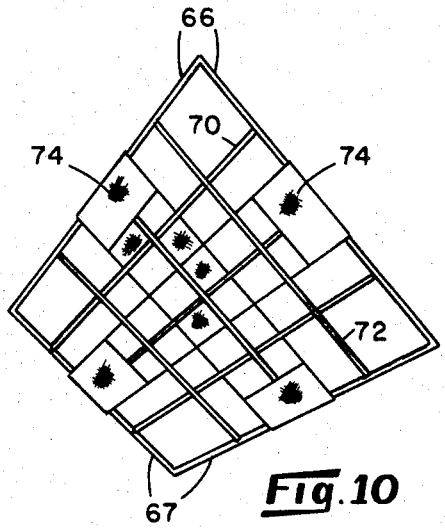
Figure 11:
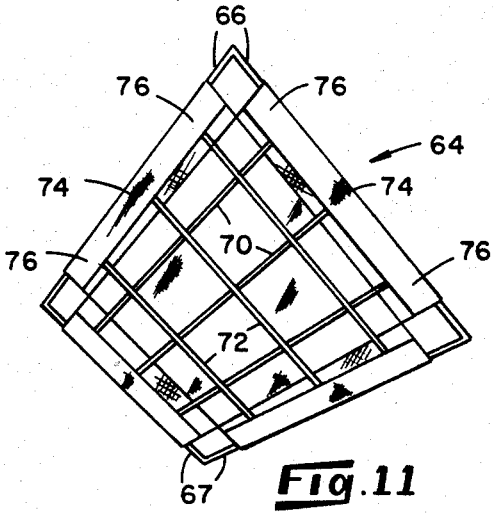

As illustrated in FIGS. 9 through 11, the preferred mode of application includes the application of first screen bands 74 from opposing bars. This is repeated with the other two opposing bars. Then, second screen bands 76 are applied on either side of the central screen bands as shown in FIG. 11. The screen bands are then sprayed with a plastic cement coating which hardens and forms a layer on the bands 74 and 76 and secures the bands to the pairs of bars and the cross bars 70 and 72 to result in shell elements 64 and 65.

The resultant shell elements 64 and 65 are assembled as shown in FIG. 12 to form a shell which includes a portion of the framework 44 and which includes the plastic-embedded fiberglass screen layer 54. This is accomplished by securing apex shell elements 64 and base shell elements 65 together preferably with steel banding and attaching the elements 64 and 65 to the base 48. The apex shell elements 64 are attached at adjacent roof rods 66 to form the apex 16 and the lower end of the wall rods 67 are attached to the base 48. The base hypar elements 65 are attached to the base 48 at the base rods 69 and the upright rods 68 are attached to the walls rods 67.

Preferably as illustrated in FIG. 12, interconnection rods 71, such as #3 rebar, are bent at an appropriate angle to overlie adjacent hypars and extend generally parallel to the cross bars 70 and 72. Preferably, the interconnection rods 71 are welded to the rods of adjacent hypars to attach adjacent hypars and to contribute the overall strength of the reinforcing framework 44.

A layer of concrete is applied, preferably by spraying over the shell, to form the first layer of concrete 56 (see FIG. 4) which is generally of uniform thickness. Then, a layer of reinforcing bars are applied over the shell to result in the second layer of bars **50*b* to result in the overall configuration of rods as illustrated in FIG. 12. As shown, the second layer of bars is suitably provided by welded #6 rebar is arranged so that the second layer of cross rods 78 are between the first and second cross bars 70 and 72, respectively, below them. In addition, a tensile ring rod 80, such as #8 rebar, is preferably connected such as by welding between adjacent interconnections between the roof rods 66, wall rods 67 and upright rods 68 of the second layer of bars 50*b* to provide additional support to the structure 10**.

A second layer of concrete is then sprayed onto the shell to form the second layer of concrete 58. Following the second layer of concrete, the resilient waterproof layer such as a fiberglass mat 60 (see FIG. 4) is applied over the entire structural module and a layer of asphalt 62 is applied to the glass mat.

Optionally, a second unreinforced layer of concrete applied between the second layer and the resilient waterproof layer. In the interior, an anti-spall layer is then applied if desired which preferably is a layer of polyester screen 52 (see FIG. 4) which is embedded in acrylic plastic. The anti-spall layer can be applied to the shell elemtns 64 and 65 before assembly, if desired.

In use, the structural modules 10 are employed alone or with other modules to make an interconnected structural module of two or more interconnected modules. The structural modules are used as surface structures or are buried as desired or earth is mounded up onto the structural modules to form a mound enclosing the structural module. Preferably, the module 10 is buried to a depth sufficient to cause earth arching over the module 10. Conventional means for ingress and egress are employed with the structural modules according to the present invention.

The structural module of the present invention is resistant to external forces and can be used alone or joined to like modules to form a structure which is suitable for use for underground housing, for storm shelters, and is particularly well-suited for use as an under-ground bomb shelter. In the preferred form, the structural module has a frame of rigid members and a composite material incorporating the frame that enables a module to function as a compressive structural module. The composite also has tensile strength to enable the structural module to operate as a tensile structure.

In the environment of an underground bomb shelter, the present invention provides significant advantages. The mass of the rigid and massive layer help absorb and dissipate the shock from a bomb blast. Should compressive forces cause the rigid layers to fail, the structure will remain intact due to the tensile strength of the module. In addition, the structural module includes flexible or resilient layers which impart waterproofing characteristics and the structural module will remain watertight even if the rigid layers should fail. The polyester screening embedded in acrylic plastic on the inside of the structural module provides high resistance to spalling because these layers are resilient and can catch any spalling which may occur.

The modules of the present invention are easily joined to form a single larger enclosed space with essentially no loss in blast resistance. The modules of the present inventions can be constructed less expensively for the same usable square footage which compared to conventional blast resistant structural modules. In addition, using the method of the present invention, modules can be constructed on site with unskilled labor from only two types of prefabricated shell elements. Because the prefabricated shell elements are lightweight compared to the finished structural module. The shell elements can be airlifted and the heavy materials such as the concrete and asphalt can be obtained locally.

Because of the great structural integrity of the module, small openings can be provided either during or after construction to allow for various functions such as plumbing, ventilation, light, ingress, egress and other such functions.

A structural module such as the preferred embodiment described having a usable floor area of 2,200 square feet and with a laminar composite as shown in FIG. 4 with thickness of approximately 6 inches has an equal or better blast resistance than a rectangular box structural module with a wall thickness of 37.4 inches (0.950 meter) or a barrel vault with a shell thickness of 31.7 inches (0.805 meter). Blast tests on a structural module according to the present invention with a buried 1000 pound bomb near the base or near the apex resulted in no breach of any surface and produced no spalling within the structural module. Such blast is capable of breaching a planar wall of 30–40 inches reinforced concrete.

While preferred embodiments of the present invention have been shown and described in the specification and drawings, it will be understood that there is no intention to limit the invention by the disclosure but instead it is intended to cover all modifications and alternate constructions falling within the spirit and scope of the invention as set forth in the appended claims.

What is claimed is:

1. A structural module having an apex for forming an enclosed space over a floor comprising:

generally rigid base means having a generally planar surface providing the floor;

at least three apex hypars joined together at the apex over the floor to form an enclosed space with at least three triangular openings formed between said apex hypars and the floor;

at least one base hypar formed between one of the triangular openings and the floor for supporting said apex hypars and for closing one of said openings between said apex hypars and the floor;

said apex hypars comprising:

a support point adjacent to the floor;

a pair of linear wall edges joined at the support point at their lower ends and extending upwardly and outwardly therefrom to their upper ends;

a pair of linear roof edges, each roof edge having a lower end joined to the upper end of one of said wall edges respectively, the upper ends of said roof edges being joined together at the apex of the module structure;

a surface disposed within said wall edges and roof edges and having a double opposed curvature wherein said surface has a convex cross-section in a vertical plane passing through said apex and said support point and has a concave cross-section in a second plane nonparallel to the vertical plane;

said base hypar comprising:

a basepoint located adjacent to the floor and disposed outwardly on the floor from two adjacent support points, said base point and two adjacent support points defining a triangle on the floor;

a pair of base edges, each of said base edges extending from said base point to one of said adjacent support points;

two upright edges extending upwardly from said two adjacent support points and being joined together at their upper ends, said upright edges also being said wall edges of two adjacent apex hypars; and a surface disposed within said base edges and having a double opposed curvature wherein said surface has a concave cross-section in a vertical base plane passing through the apex and the base point and has a convex curvature in a second base plane nonparallel to the vertical base plane;

said apex hypars and said base hypars being attached to and being supported by said generally rigid base means to form the enclosed space.

2. The module of claim 1 wherein a wall edge of one apex hypar and an adjacent wall edge of a second apex hypar are disposed in a substantially vertical plane to define a substantially vertical triangular opening in said module, whereby two of the modules may be joined together to form one enclosed space by joining together the vertical triangular openings of the two modules.

3. The module of claim 1 comprising:

four apex hypars joined together at the apex to form four openings; and a plurality of base hypars covering a plurality of said openings.

4. The module of claim 1 comprising:

six apex hypars joined together at the apex to form six openings; and a plurality of base hypars covering a plurality of said openings.

5. The module of claim 1 further comprising at least one A-frame structure mated with one of said triangular openings to form a side room on the shelter defined by said apex hypars and base hypar.

6. The structural module of claim 1 further comprising sufficient earth covering said apex hypars and said base hypars to establish earth arching.

7. A blast resistant modular structure formed over a floor comprising:

generally rigid base means having a generally planer surface providing the floor;

at least three apex hypars joined together at an apex over the floor to form a shelter with at least three triangular openings formed between said apex hypars and the floor;

at least one base hypar formed between one of the triangular openings and the floor for supporting said apex hypars and for forming an enclosed space with said apex hypars;

said apex and base hypars being buried under earth to a depth sufficient to establish earth arching;

said apex hypars comprising:

a support point adjacent to the floor; a pair of linear wall edges joined at the support point at their lower ends and extending upwardly and outwardly therefrom to their upper ends;

a pair of linear roof edges, each roof edge having a lower end attached to the upper end of one of said wall edges respectively, the upper ends of said roof edges being joined together at the apex of the module structure;

a surface disposed within said wall edges and roof edges and having a double opposed curvature wherein said surface has a convex cross-section in a vertical plane passing through said apex and said support point and has a concave cross-section in a second plane nonparallel to the vertical plane;

said base hypar comprising:

a basepoint located adjacent to the floor and disposed outwardly on the floor from two adjacent support points, said base point and two adjacent support points defining a triangle on the floor;

a pair of base edges, each of said base edges extending from said base point to one of said adjacent support points;

two upright edges extending upwardly from said two adjacent support points and being joined together at their upper ends, said upright edges also being said wall edges of two adjacent apex hypars; and a surface disposed within said base edges and having a double opposed curvature wherein said surface has a concave cross-section in a vertical base plane passing through the apex and the base point and has a convex curvature in a second base plane nonparallel to the vertical base plane;

said apex hypars and said base hypars being attached to and supported by said generally rigid base means to form an enclosed space.

8. A blast resistant modular structure formed over a floor comprising:

at least three apex hypars joined together at an apex over the floor to form a shelter with at least three triangular openings formed between said apex hypars and the floor;

at least one base hypar formed between one of the triangular openings and the floor for supporting said apex hypars and for forming an enclosed space with said apex hypars;

said apex and base hypars being buried under earth to a depth sufficient to establish earth arching;

said apex hypars comprising:

a support point adjacent to the floor;

a pair linear wall edges joined at the support point at their lower ends and extending upwardly and outwardly therefrom to their upper ends;

a pair of linear roof edges, each roof edge having a lower end attached to the upper end of one of said well edges respectively, the upper ends of said roof edges being joined together at the apex of the module structure;

a surface disposed within said wall edges and roof edges and having a double opposed curvature wherein said surface has a convex cross-section in a vertical plane passing through said apex and said support point and has a concave cross-section in a second plane nonparallel to the vertical plane;

said base hypar comprising:

a basepoint located adjacent to the floor and disposed outwardly on the floor from two adjacent support points, said base point and two adjacent support points defining a triangle on the floor;

a pair of base edges, each of said base edges extending from said base point to one of said adjacent support points;

two upright edges extending upwardly from said two adjacent support points and being joined together at their upper ends, said upright edges also being said wall edges of two adjacent apex hypars; and a surface disposed within said base edges and having a double opposed curvature wherein said surface has a concave cross-section in a vertical base plane passing through the apex and the base point and has a convex curvature in a second base plane nonparallel to the vertical base plane;

wherein each of said apex hypars comprises:

a pair of steel wall rods forming said wall edges;

a pair of steel roof rods forming said roof edges;

a plurality of steel cross rods extending between said wall rods and said roof rods;

a screen stretched between the attached to said roof rods and wall rods and being disposed adjacent said cross rods; and a layer of concrete encasing said wall rods, roof rods and cross bars.

9. The blast resistant structure of claim 8 wherein each of said apex hypars comprises:

a pair of steel wall rods forming said wall edges;

a pair of steel roof rods forming said roof edges;

a plurality of steel cross rods extending between said wall rods and said roof rods in a crossing pattern;

a plurality of glass fiber screen cross bands tensioned between said wall rods and said roof rods in a crossing pattern to form a substantially continuous screen surface between said wall and roof rods below said steel cross rods;

a plastic cement coated onto and encasing said glass fiber screen;

a polyester screen disposed below and attached to said glass fiber screen and plastic cement;

an acrylic coating formed on and encasing said polyester screen; and at least one layer of concrete formed on said glass fiber screen and encasing said cross rods.

10. The blast resistant structure of claim 9 further comprising:

glass mat disposed on and above said layer of concrete; and a layer of asphalt formed on and above said glass mat.

* * * * *